US006474024B1

(12) United States Patent
Macintyre

(10) Patent No.: US 6,474,024 B1
(45) Date of Patent: Nov. 5, 2002

(54) VARIABLE RISER SEATING SYSTEM

(76) Inventor: James R. Macintyre, 887 Bucks Lake Rd., Los Angeles, CA (US) 95971

( * ) Notice: Subject to any disclaimer, the term of this patent is extended or adjusted under 35 U.S.C. 154(b) by 0 days.

(21) Appl. No.: 09/986,062

(22) Filed: Nov. 7, 2001

(51) Int. Cl.[7] ..... E04H 3/12
(52) U.S. Cl. ..... 52/9; 52/6; 52/8; 52/10; 52/183
(58) Field of Search ..... 52/9, 10, 8, 6, 52/183

(56) References Cited

U.S. PATENT DOCUMENTS 4,497,154 A * 2/1985 Johnson ..... 52/6
5,660,000 A * 8/1997 MacIntyre ..... 108/115
6,003,270 A * 12/1999 MacIntyre ..... 52/10
6,244,657 B1 * 6/2001 Momose ..... 297/217.7
6,324,790 B1 * 12/2001 Victor et al. ..... 297/236

* cited by examiner

*Primary Examiner*—Carl D. Friedman
*Assistant Examiner*—Christy M. Green
(74) *Attorney, Agent, or Firm*—Dykema Gossett PLLC

(57) ABSTRACT

The seating section of a seating system is variable in slope between high riser and low riser positions forward ends of the pivotable treads forming a deck surface overlap confronting ends of adjacent treads, and lever arms maintain the treads substantially level irrespective of inclination of the underlying support beams. The arms are pivotable between angular and upright positions and extend between each of the treads and the beams. The forward ends of the treads are supported on support plates mounted on the support beams in a low riser height position of the seating section, and the lever arms support the forward ends of the treads on the support plates in a high riser position of the seating section.

6 Claims, 2 Drawing Sheets

VARIABLE RISER SEATING SYSTEM

BACKGROUND OF THE INVENTION

This invention relates generally to a seating system in which the understructure of each seating section can be varied in slope to provide different sight lines for different stadium and arena configurations. More particularly, the invention represents an improvement over my prior U.S. Pat. No. 6,003,270. My earlier patented variable riser seating system provides lever arms for maintaining the transversely extending treads of the upper deck surface substantially level upon changing of the slope of the longitudinal support beams of the seating section. The treads are pivotally connected at one end to the beams and are pivotally connected at opposite ends to the lever arms, such opposite ends overlapping and being supported on an adjacent tread in the forward direction at a low riser height. The lever arms support the opposite ends of the treads on the beams when the arms are shifted to their substantially upright positions in a high riser height position of the seating system.

Although my patented variable riser seating system has enjoyed widespread success, it is desirable to improve upon the structural integrity of the system to render it more reliable and easier to manipulate.

SUMMARY OF THE INVENTION

It is therefore an object of the present invention to provide a seating section of a seating system which offers improvements over the seating system of the U.S. Pat. No. 6,003,270 in ease of operation, reliability and structural integrity. The present system is similar to my prior system in that it is structured to have a variable slope with treads pivotally mounted on hingedly mounted longitudinal support beams such that the riser heights are varied to maintain the required sight lines which permit use of a single seating system for multiple seating configurations such as ice hockey which typically requires a high riser height and such as basketball which typically requires a low riser height.

In the seating system according to the invention, the ends of the treads opposite their pivoting ends overlap adjacent treads, and lever arms are pivotable between angular and upright positions and extend between each of the treads and the underlying longitudinal beams for maintaining the treads substantially level in the low and high riser height positions of the treads. The opposite ends of the treads are supported on support plates mounted on the beams in the low riser height position, and the lever arms support the opposite ends of the treads on the support plates in the high riser height position of the seating section.

The lever arms extend between and are pivotally connected at opposite ends to the tread opposite ends and to tie rods lying parallel to the longitudinal beams and shiftable along their axes for pivotally moving the rods between their angular and upright positions to respectively effect low riser height and high riser height positions. The tie rods are roller supported beneath the longitudinal structural beams to effect a smooth and unimpeded variation in slope of the seating section.

Other objects, advantages, and novel features of the invention will become more apparent from the following detailed description of the invention when taken in conjunction with the accompanying drawings.

DETAILED DESCRIPTION OF THE INVENTION

Figure 1:
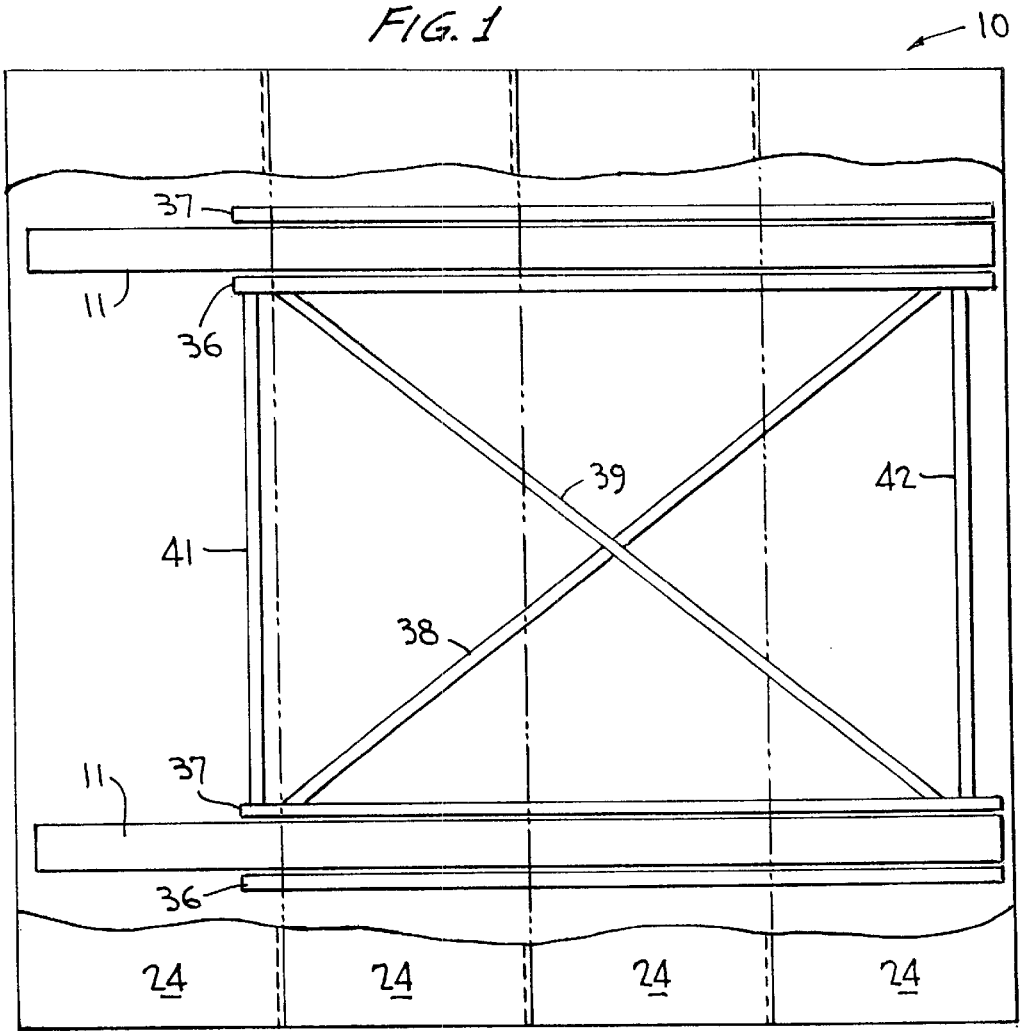
FIG. 1 is a top plan view of a seating section of the seating system according to the invention.
Figure 2:
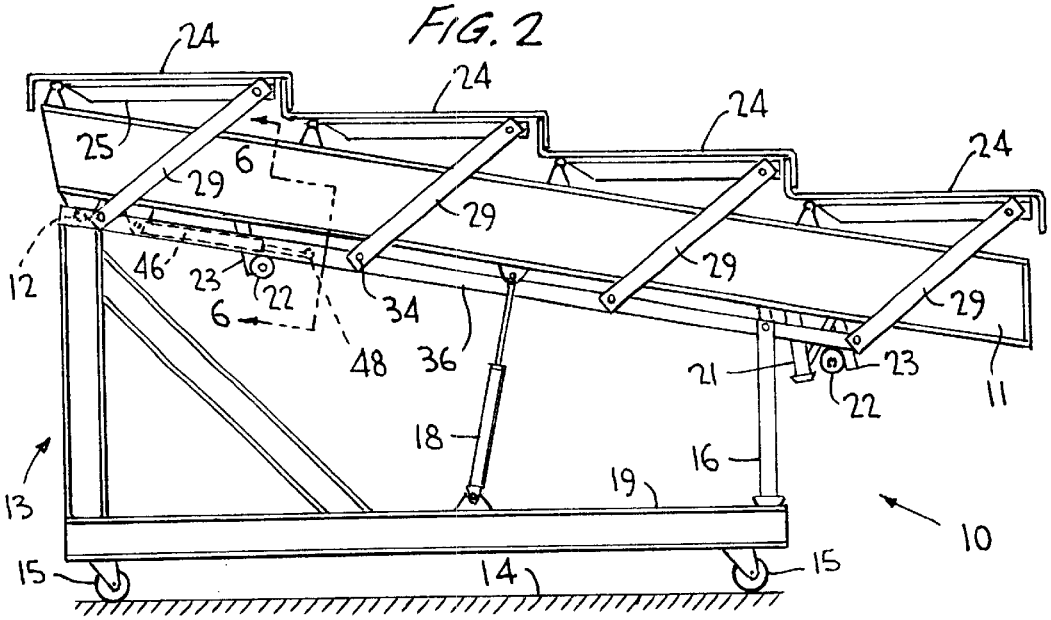
FIG. 2 is a side elevational view of the seating section of FIG. 1 showing the seat treads in a low riser position.
Figure 3:
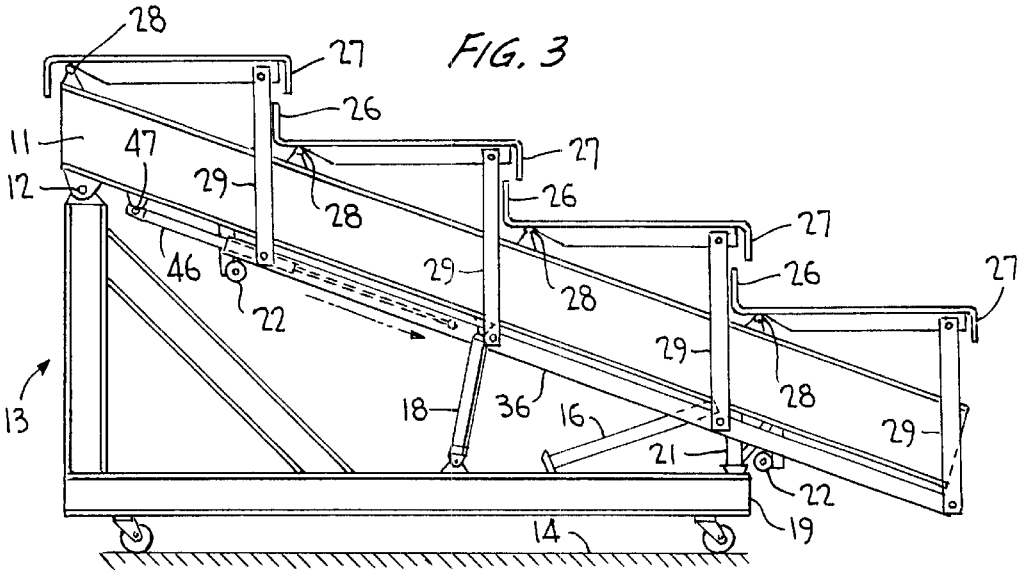
FIG. 3 is a view similar to FIG. 2 showing the seat treads in a high riser position.

Turning now to the drawings wherein like reference characters refer to like and corresponding parts throughout the several views, the seating section according to the invention is generally designated 10 in FIGS. 1 to 3 as part of the seating system which includes a number of seating sections 10 arranged side-by-side around the perimeter of an arena or stadium outside the central playing/entertaining area. Each section includes at least a pair of spaced longitudinal support beams 11 hingedly connected at the rearward end thereof as at 12 to a moveable frame 13 supported on floor 14 of the arena/gymnasium by swivel rollers 15. Instead, each section 10 could otherwise be hingedly connected to a permanent vertical wall of the arena or stadium such as that shown in the aforementioned U.S. Pat. No. 6,003,270.

Figure 6:
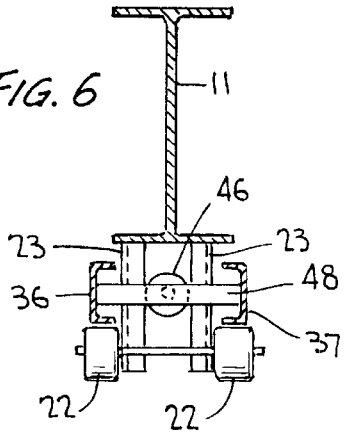
FIG. 6 is a sectional view taken substantially along the line 6—6 of FIG. 2.

In seating section 10 shown in FIG. 2 in the low riser position which is typically a seating position preferred for basketball, the front of the beams are supported by a folding front beam support 16 which may have a flared cup/base 17. Lifting cylinders 18, which may be hydraulic/pneumatic piston/cylinder units, extend between lower horizontal beam 19 of the frame and support beam 11, there being a lifting cylinder for each support beam hinged to the beam at one end and to horizontal beam 19 at its other end. Each support beam 11 is further provided with a fixed front beam support 21, and roller supports comprising pairs of rollers 22 axle supported to each longitudinal support beam 11 near the forward and rearward ends thereof (see FIG. 2) via depending pairs of support bars 23 (see FIG. 6).

The deck surface of each seating section comprises a plurality of deck or tread plates 24 each having underlying support angles 25 and each having an upturned flange 26 at its rearward end and a downturned flange 27 at its forward end, with the exception of the uppermost deck plate 24, as shown in FIGS. 2 and 3. Each deck plate 24 may be hinged at or near its rearward end to support beams 11 as at 28. In the low riser position of FIG. 2 downturned flanges 27 overlap upturned flanges 26, and in the high riser position of the seating section of FIG. 3 the flanges likewise overlap except that they are out of contact engagement.

When the slope of the seating section is changed from its low riser height of FIG. 2 to its high riser height of FIG. 3, and vice-versa, deck plates or treads 24 must be maintained horizontal or substantially horizontal between the forward and rearward ends thereof. For this purpose, pairs of lever arms 29, 31 straddle each support beam 11 (see FIG. 7) and are hingedly connected as at 32, 33 at the upper ends thereof, and hingedly connected as at 34, 35 at the lower ends thereof to pairs of tie rods 36, 37. The inner tie rods of each pair are cross-braced as at 38, 39, 41, 42 (see FIG. 1).

Figure 7:
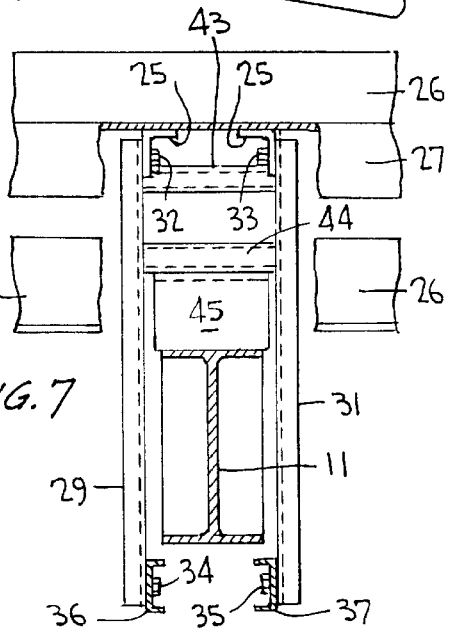
FIG. 7 is a view taken substantially along the line 7—7 of FIG. 4.

Spanning the pairs of support angles 25 and fixed thereto, at the forward end of each tread, is a support bar 43 (see FIG. 7), and spanning pairs 29, 31 of the lever arms associated with each tread and fixed thereto, is another support bar 44 (see FIG. 7).

Figure 4:
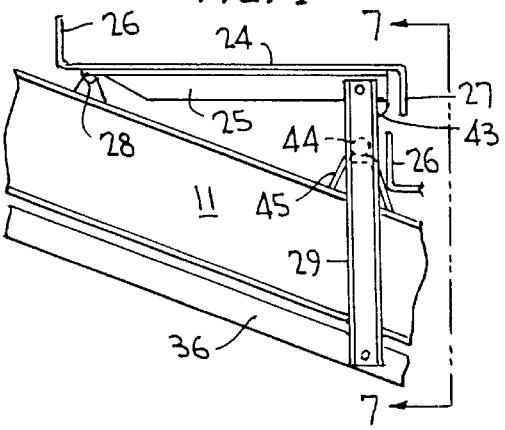
FIG. 4 is a view similar to FIG. 3 showing a part of the seating section in more detail at an enlarged scale.
Figure 5:
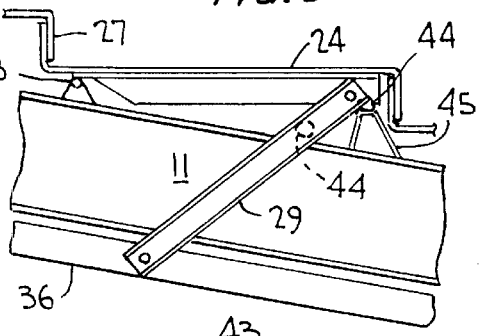
FIG. 5 is a view similar to FIG. 4 showing the seating section portion of FIG. 2 at an enlarged scale.

As will be described in more detail hereinafter, the support bars respectively rest on support plates 45 which may be trapezoidal in crosssection, as shown in FIGS. 4 and 5, the support plates being mounted on the top flange of support beams 11 (FIG. 7). Finally, actuators 46 are provided for each pair of tie rods 36, 37 and are hinged as at 47 to the underside of each beam 11, and at the other end are hingedly connected via cross bar 48 (FIG. 6) to tie rods 36, 37. Actuators 46 may be hydraulic/pneumatic piston/cylinder units of any available variety.

In operation, with the seating section in its low riser or basketball position of FIG. 2, the slope of the entire seating section may be changed to the high riser or ice hockey position of FIG. 3 by first manually folding beam supports 16 inwardly, and lowering support beams 11 by retracting the pistons of lifting cylinders 18 such that the support beams pivot downwardly about hinges 12 until their front beam supports 21 rest on horizontal beams 19 of frame 13. To adjust the seating treads so as to maintain them horizontal, the pistons of actuators 46 are extended for shifting lever arms 29, 31 from their angular positions of FIG. 2 to their substantially upright positions of FIG. 3. During this process, tie rods 36, 37 slide in a forward direction parallel to support beams 11 as roller mounted by roller pairs 22 which are suspended from beneath the support beams. While in the low riser position of FIG. 2, and as more clearly shown in FIG. 5, the forward ends of treads 24 are supported on the top of support plates 45 as support bar 43 rests thereon for supporting each tread in a positive and secure manner. Also in the low riser position, downturned flanges 27 overlap upturned flanges 26 of the adjacent treads and snugly embrace such that upturned flanges 26 provide additional support for the forward ends of the adjacent treads.

In the high riser height position of FIGS. 3 and 4, support bar 44 bears on the top of support plate 45 for each tread (see also FIG. 7) for securely supporting the forward ends of the treads on the support beams in the high riser position.

When the seating configuration is to be changed from ice hockey back to basketball, for example, the cylinders of actuators 18 are extended and folding beam supports 16 are folded back to their erect positions of FIG. 2. And, the pistons of actuators 46 are retracted for shifting lever arms 29, 31 from their upstanding positions of FIG. 3 back to their forward angular positions of FIG. 2. During this process support bar 44 is shifted away from support plate 44 and support bar 43 is lowered to rest on support plate 45 when moving from the FIG. 4 to the FIG. 5 positions.

In the low riser position of FIG. 2, a portable seating section (not shown) may be arranged to smoothly transition between the forward end of each section 10 and the floor, as shown in phantom outline in the aforementioned U.S. Pat. No. 6,003,270. And, removable steps may be provided on treads 24 at designated aisles, if desired.

From the foregoing it can be seen that a simply operating and economically producible yet highly effective variable riser seating system has been developed which improves upon known prior systems.

Obviously, many modifications and variations of the present invention are made possible in the light of the above teachings. It is therefore to be understood that within the scope of the appended claims, the invention may be practiced otherwise than as specifically described.

What is claimed is:

1. A seating section of a seating system, comprising a pair of spaced longitudinal support beams and an occupant supporting deck surface mounted on the beams, the beams having an adjustable inclination to the horizontal and sloping downwardly in a forward direction, means for adjusting the inclination of the beams between a first position and a steeper second position, the deck surface comprising transversely extending treads pivotally mounted at one end thereof to said beams, ends of said treads opposite said one end overlapping adjacent treads, lever arms for maintaining said treads substantially level irrespective of the inclination of said beams, said arms being pivotable between angular and upright positions and extending between each of said treads and said beams, support plates fixedly mounted on said beams each adjacent the one end of the pivotally mounted treads, said opposite ends of said treads being supported solely on said support plates in a low riser height in said first position and said lever arms supporting said opposite ends on said support plates in a high riser height of said second position.

2. The seating section according to claim 1, wherein said lever arms are pivotally connected at one end to said treads and are pivotably connected at opposite ends thereof to tie rods disposed parallel to said beams.

3. The seating section according to claim 2, wherein said tie rods are supported by rollers mounted to the beams at undersides of said beams.

4. The seating section according to claim 2, wherein actuator means on said beams are connected to said tie rods for shifting sain pivotally connected opposite ends of said lever arms between said angular and upright positions.

5. The seating section according to claim 1, wherein transversely extending first support rods are mounted on said treads for directly supporting said opposite ends thereof on said support plates.

6. The seating section according to claim 1, wherein said opposite ends of said treads are supported on said plates in said second position by the provision of transversely extending second support rods mounted on said lever arms.

* * * * *